United States Patent [19]

McCue, Jr. et al.

[11] Patent Number: 4,900,347

[45] Date of Patent: Feb. 13, 1990

[54] CRYOGENIC SEPARATION OF GASEOUS MIXTURES

[75] Inventors: Richard H. McCue, Jr., Houston; John L. Pickering, Jr., Kingwood, both of Tex.

[73] Assignee: Mobil Corporation, New York, N.Y.

[21] Appl. No.: 333,214

[22] Filed: Apr. 5, 1989

[51] Int. Cl.[4] ..... F25J 3/02

[52] U.S. Cl. ..... 62/24; 62/28; 62/32

[58] Field of Search ..... 62/24, 28, 29, 31, 32

[56] References Cited

U.S. PATENT DOCUMENTS

| | | | |
|---|---|---|---|
| 4,002,042 | 1/1977 | Pryor et al. | 62/28 |
| 4,270,939 | 6/1981 | Rowles et al. | 62/22 |
| 4,270,940 | 6/1981 | Rowles et al. | 62/28 |
| 4,368,061 | 1/1983 | Mestrallet et al. | 62/24 |
| 4,464,189 | 8/1984 | Tedder | 62/24 |
| 4,501,600 | 2/1985 | Pahade | 62/28 |
| 4,548,629 | 10/1985 | Chtu | 62/24 |

OTHER PUBLICATIONS

Better Ethylene Separation Unit, *Hydrocarbon Processing* (Nov. '88).

NPRA paper "Increased Olefins Production", Bernard et al. (1988).

Canadian Journal of Chemical Engineering, vol. 65, Aug. 1987, Cave et al.

*Primary Examiner*—Ronald C. Capossela

*Attorney, Agent, or Firm*—Alexander J. McKillop; Charles J. Speciale; L. Gene Wise

[57] ABSTRACT

A cyrogenic technique for recovering ethene from a gaseous mixture containing methane, ethane, etc. Operating methods and apparatus are provided for passing the gas feed through a chilling train having a series of dephlegmator-type exchange units to condense liquid rich in ethene and ethane, while separating a major portion of methane and lighter gas. A multizone demethanizer removes condensed methane from the $C_2$ fraction to provide a pure product economically.

23 Claims, 2 Drawing Sheets

128V
128
128L
126L
126
126R
126D
138V
138
138R
128R
136
$C_2R$
134V
134
134L
ETHENE
$C_3R$
133H
133V
133
133L
$C_2^+$
132
130R
131
130L
130
124L
124
124R
124D
122
$C_1+H_2$
RECYCLE ETHANE
120V
120
120R
120D
118
117
115

CRYOGENIC SEPARATION OF GASEOUS MIXTURES

BACKGROUND

The present invention relates to improvements in cold fractionation of light gases. In particular it relates to a new method for recovering ethene (ethylene) from cracking gas or the like in mixture with methane, ethane and other components requiring low temperature refrigeration.

Cryogenic technology has been employed on a large scale for recovering gaseous hydrocarbon components, such as $C_1$-$C_2$ alkanes and alkenes from diverse sources, including natural gas, petroleum refining, coal and other fossil fuels. Separation of high purity ethene from other gaseous components of cracked hydrocarbon effluent streams has become a major source of chemical feedstocks for the plastics industry. Polymer grade ethene, usually containing less than 1% of other materials, can be obtained from numerous industrial process streams. Thermal cracking and hydrocracking of hydrocarbons are employed widely in the refining of petroleum and utilization of $C_2$+ condensible wet gas from natural gas or the like. Low cost hydrocarbons are typically cracked at high temperature to yield a slate of valuable products, such as pyrolysis gasoline, lower olefins and LPG, along with byproduct methane and hydrogen. Conventional separation techniques near ambient temperature and pressure can recover many cracking effluent components by sequential liquefaction, distillation, sorption, etc. However, separating methane and hydrogen from the more valuable $C_2$+ aliphatics, especially ethene and ethane, requires relatively expensive equipment and processing energy.

Plural stage rectification and cryogenic chilling trains have been disclosed in many publications, especially Perry's Chemical Engineering Handbook (5th Ed), and other treatises on distillation techniques. Recent commercial applications have employed dephlegmator-type rectification units in chilling trains and as reflux condenser means in demethanization of gas mixtures. Typical rectification units are described in U.S. Pat. Nos. 2,582,068 (Roberts); 4,002,042, 4,270,940, 4,519,825, 4,732,598 (Rowles et al); and 4,657,571 (Gazzi), incorporated herein by reference. Typical prior demethanizer units have required a very large supply of ultra low temperature refrigerant and special materials of construction to provide adequate separation of $C_1$-$C_2$ binary mixtures or more complex compositions. As reported by Kaiser et al in *Hydrocarbon Processing*, Nov. 1988, pp 57–61, a better ethylene separation unit with improved efficiency can utilize plural demethanizer towers. Ethene recovery of at least 99% is desired, requiring essentially total condensation of the $C_2$+ fraction in the chilling train to feed the distillation towers. It is known that the heavier $C_3$+ components, such as propylene, can be removed in a front end deethanizer; however, this expedient can be less efficient than the preferred separation technique employed herein.

It is an object of the present invention to provide an improved cold fractionation system for separating light gases at low temperature which :s energy efficient and saves capital investment in cryogenic equipment.

SUMMARY OF THE INVENTION

A new cryogenic technique has been found for separating and recovering $C_2$+ hydrocarbons from a feed gas comprising methane, ethene and ethane, optionally including hydrogen and minor amounts of $C_3$+ components, wherein cold pressurized gaseous streams are separated in a plurality of rectification chilling zones, preferrably dephlegmator units. In the optimum design configuration, each of the dephlegmator units is operatively connected to accumulate condensed $C_2$-rich liquid in a lower dephlegmator drum vessel by gravity flow from an upper dephlegmator heat exchanger. This invention provides methods and means for: introducing dry feed gas into a primary dephlegmation zone having a plurality of serially connected, sequentially colder dephlegmator units for separation of feed gas into a primary methane-rich gas stream recovered at low temperature and at least one primary liquid condensate stream rich in $C_2$+ hydrocarbon components and containing a minor amount of methane; passing at least one primary liquid condensate stream from the primary dephlegmation zone to serially connected demethanizer fractionators, wherein a moderately low cryogenic temperature is employed in a first demethanizer fractionator unit to recover a major amount of methane from the primary liquid condensate stream in a first demethanizer overhead vapor stream and to recover a first $C_2$+ liquid demethanizer bottoms stream substantially free of methane; and further separating at least apportion of the first demethanizer overhead vapor stream in an ultra-low temperature final demethanizer fractionator unit to recover ethene-rich $C_2$ hydrocarbon liquid product and a final demethanizer ultra-low temperature overhead vapor stream, whereby energy requirements for refrigeration utilized in separating the $C_2$+ hydrocarbons from methane and lighter components are low.

A methane-rich stream may be obtained by passing the final demethanizer overhead vapor stream to a final dephlegmator unit to obtain a final liquid reflux stream for recycle to a top portion of the final demethanizer fractionator and a final dephlegmator overhead vapor stream substantially free of $C_2$+ hydrocarbons.

Improved cryogenic separation apparatus has been designed for recovering a higher-boiling first gaseous component from a lower-boiling second gaseous component in a feedstock mixture thereof comprising: a source of primary coolant, moderately low temperature refrigerant and ultra low temperature coolant; sequential chilling train means including a primary dephlegmator unit operatively connected in serial flow relationship with intermediate and final dephlegmator units, wherein a cold pressurized gaseous stream is separated in the series of dephlegmator units, each of said dephlegmator units having means for accumulating condensed liquid rich in higher-boiling component in a lower dephlegmator drum from an upper dephlegmator heat exchanger wherein gas flowing upwardly is partially condensed to form a reflux liquid in direct contact with upward flowing gas to provide a condensed stream of cooler liquid flowing downwardly and thereby enriching condensed dephlegmator liquid gradually with higher-boiling component; means for feeding dry pressurized feedstock to the primary dephlegmator unit for sequential chilling to separate the feedstock mixture into a primary gas stream rich in lower boiling component recovered at about primary coolant temperature and a primary liquid condensate stream rich in higher boiling component and containing a minor amount of lower boiling component.

Fluid handling means is provided for passing the primary liquid condensate stream from the primary dephlegmator unit to a low temperature fractionation system for recovering condensed lower-boiling components from condensed liquid. The fractionation system has a first fractionation zone including first reflux condenser means operatively connected to the source of moderately low temperature coolant to recover a major amount of lower-boiling component from the primary liquid condensate stream in a first fractionator overhead vapor stream and to recover a first liquid fractionator bottoms stream substantially free of lower-boiling component. The fractionation system also has a second fractionation zone including second reflux condenser means operatively connected to the source of ultra low temperature coolant to recover a liquid product stream consisting essentially of higher boiling component and a second fractionator ultra-low temperature overhead vapor stream. Advantageously, the system is provided with means for passing an intermediate liquid stream condensed from at least one intermediate dephlegmator unit to a middle stage of the second fractionation zone and a final dephlegmator unit connected to receive the second fractionator overhead vapor stream, including ultra low temperature refrigerant heat exchange means for obtaining a final liquid reflux stream for recycle to an upper stage of the second fractionation zone and a final dephlegmator overhead vapor stream substantially free of higher-boiling components.

For improved energy efficiency this system may include means for contacting at least a portion of said first demethanizer fractionator overhead vapor stream in heat exchange relationship with an intermediate liquid stream, thereby reducing ultra low temperature refrigeration requirements for the second reflux condenser means. This can by effected by providing a countercurrent direct stream contact unit operatively connected between the primary and secondary fractionator zones, with liquid from the countercurrent contact zone being directed to a lower stage of the secondary fractionator zone and vapor from the interfractionator liquid-gas contact zone being directed to a higher stage of the secondary demethanizer zone.

THE DRAWINGS

FIG. 1 is a schematic process flow diagram depicting arrangement of unit operations for a typical hydrocarbon processing plant utilizing cracking and cold fractionation for ethene production; and FIG. 2 is a detailed process and equipment diagram showing a plural chilling train and dual demethanizer fractionation system utilizing dephlegmators.

DESCRIPTION OF PREFERRED EMBODIMENTS

In the following description, metric units and parts by weight are used unless otherwise stated, and gaseous mixtures are sometimes given in moles or mol %. Temperature is given in degrees Celcius (°C.) or Kelvin (°K.). In the process of separating $C_1$-$C_2$ gaseous components, references are made to the sources of progressively colder moderately low temperature coolant and ultra low temperature coolant, which temperature ranges are generally taken to mean about 235° to 290° K. and less than about 235° K., respectively. While at least three different refrigeration loops are used in the preferred embodiments, major refineries may have 4–8 loops within or overlapping these temperature ranges.

Cryogenic Separation Feedstocks

The present process is useful for separating mainly $C_1$-$C_2$ gaseous mixtures containing large amounts of ethene (ethylene), ethane and methane. Significant amounts of hydrogen usually accompany cracked hydrocarbon gas, along with minor amounts of $C_3$+ hydrocarbons, nitrogen, carbon dioxide and acetylene. The acetylene component may be removed before or after cryogenic operations; however, it is advantageous to hydrogenate a de-ethanized $C_2$ stream catalytically to convert acetylene prior to a final ethene product fractionation. Typical petroleum refinery off gas or paraffin cracking effluent are usually pretreated to remove any acid gases and dried over a water-absorbing molecular sieve to a dew point of about 145° K. to prepare the cryogenic feedstock mixture. A typical feedstock gas comprises cracking gas containing about 10 to 50 mole percent ethene, 5 to 20% ethane, 10 to 40% methane, 10 to 40% hydrogen, and up to 10% $C_3$ hydrocarbons.

In a preferred embodiment, dry compressed cracked feedstock gas at ambient temperature or below and at process pressure of at least 2500 kPa (350 psig), preferably about 3700 kPa (37.1 kgf/cm$^2$, 520 psig), is separated in a chilling train under cryogenic conditions into several liquid streams and gaseous methane/hydrogen streams. The more valuable ethene stream is recovered at high purity suitable for use in conventional polymerization.

Figure 1:
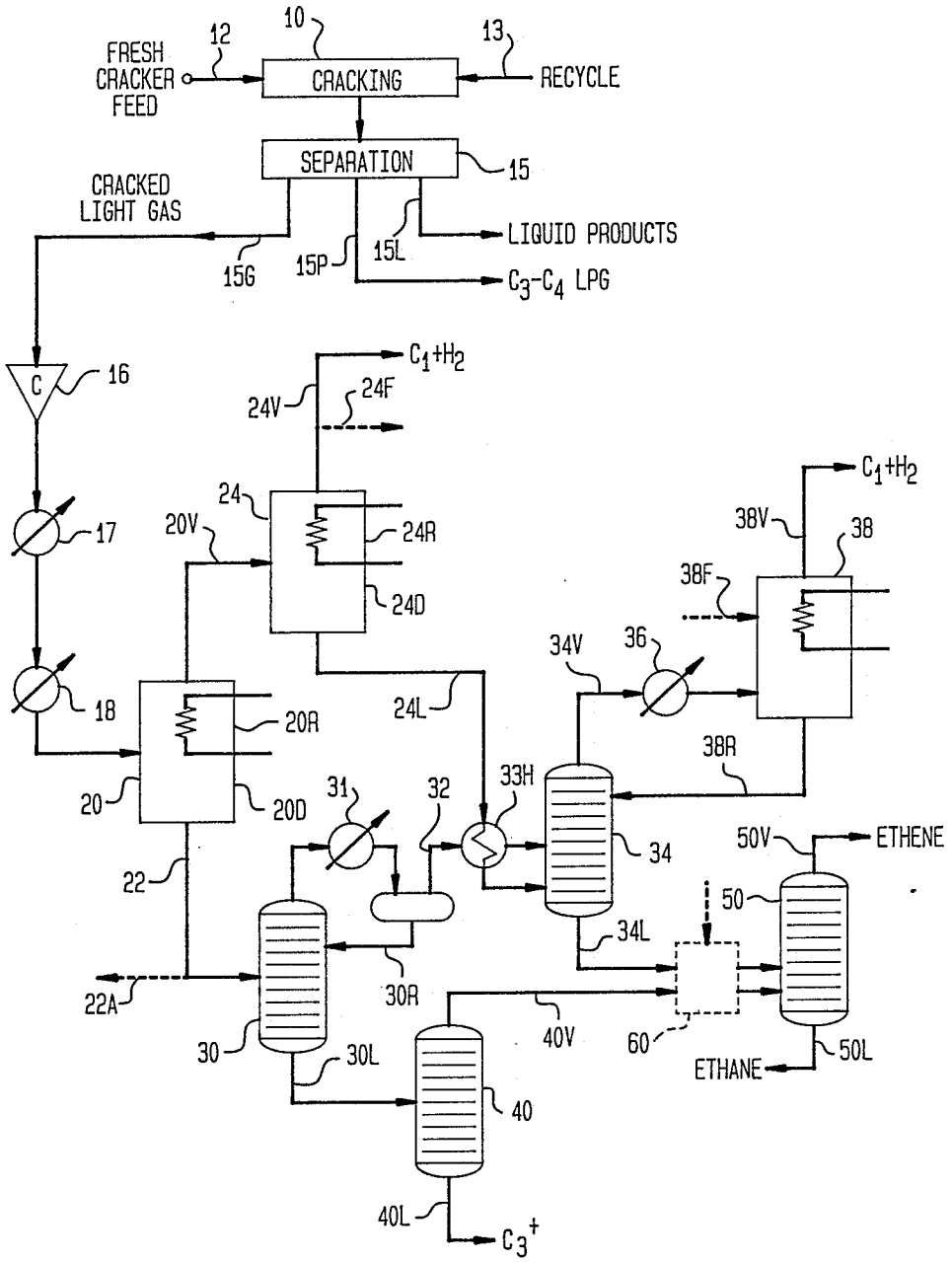

Referring to FIG. 1, a cryogenic separation system for recovering purified ethene from hydrocarbon feedstock gas is depicted in a schematic diagram. A conventional hydrocarbon cracking unit 10 converts fresh feed, such as ethane, propane, naphtha or heavier feeds 12 and optional recycled hydrocarbons 13 to provide a cracked hydrocarbon effluent stream. The cracking unit effluent is separated by conventional techniques in separation unit 15 to provide liquid products 15L, $C_3$-$C_4$ petroleum gases 15P and a cracked light gas stream 15G, consisting mainly of methane, ethene and ethane, with varying amounts of hydrogen, acetylene and $C_3$+ components. The cracked light gas is brought to process pressure by compressor means 16 and cooled below ambient temperature by heat exchange means 17, 18 to provide feedstock for the cyrogenic separation, as herein described.

In the chilling train cold pressurized gaseous streams are cooled and partially condensed in serially arranged rectification units, each of said rectification units being operatively connected to accumulate condensed liquid in a lower liquid accumulator portion by gravity flow from an upper vertical rectifier portion through which gas from the lower accumulator portion passes in an upward direction for direct gas-liquid contact exchange within said reactifier portion, whereby methane-rich gas flowing upwardly is partially condensed in said rectifier portion with cold refluxed liquid in direct contact with the upward flowing gas stream to provide a condensed stream of cold liquid flowing downwardly and thereby enriching condensed liquid gradually with ethene and ethane components. Preferrably, least one of the rectification units comprises a dephlegmator-type rectifier unit; however, a packed column or tray contact unit may be substituted in the chilling train. Dephlegmator heat exchange units are typically aluminum core structures having internal vertical conduits formed by shaping and brazing the metal, using known construction methods.

The cold pressurized gaseous feedstock stream is separated in a plurality of sequentially arranged dephlegmator-type rectification units 20, 24. Each of these rectification units is operatively connected to accumulate condensed liquid in a lower drum portion 20D, 24D by gravity flow from an upper rectifier heat exchange portion 20R, 24R comprising a plurality of vertically disposed indirect heat exchange passages through which gas from the lower drum portion passes in an upward direction for cooling with lower temperature refrigerant fluid or other chilling medium by indirect heat exchange within the heat exchange passages. Methane-rich gas flowing upwardly is partially condensed on vertical surfaces of the heat exchange passages to form a reflux liquid in direct contact with the upward flowing gas stream to provide a condensed stream of cooler liquid flowing downwardly and thereby enriching condensed liquid gradually with ethene and ethane components.

The improved system provides means for introducing dry feed gas into a primary rectification zone or chilling train having a plurality of serially connected, sequentially colder rectification units for separation of feed gas into a primary methane-rich gas stream 20V recovered at low temperature and at least one primary liquid condensate stream 22 rich in $C_2$ hydrocarbon components and containing a minor amount of methane.

The condensed liquid 22 is purified to remove methane by passing at least one primary liquid condensate stream from the primary rectification zone to a fractionation system having serially connected demethanizer zones 30, 34. A moderately low cryogenic temperature is employed in heat exchanger 31 to refrigerate overhead from the first demethanizer fractionation zone 30 to recover a major amount of methane from the primary liquid condensate stream in a first demethanizer overhead vapor stream 32 and to recover a first liquid demethanized bottoms stream 30L rich in ethane and ethene and substantially free of methane. Advantagously, the first demethanizer overhead vapor stream is cooled with moderately low temperature refrigerant, such as available from a propylene refrigerant loop, to provide liquid reflux 30R for recycle to a top portion of the first demethanizer zone 30.

An ethene-rich stream is obtained by further separating at least a portion of the first demethanizer overhead vapor stream in an ultra-low temperature final demethanizer zone 34 to recover a liquid first ethene-rich hydrocarbon crude product stream 34L and a final demethanizer ultra-low temperature overhead vapor stream 34V. Any remaining ethene is recovered by passing the final demethanizer overhead vapor stream 34V through ultra low temperature heat exchanger 36 to a final rectification unit 38 to obtain a final ultra-low temperature liquid reflux stream 38R for recycle to a top portion of the final demethanizer fractionator. A methane-rich final rectification overhead vapor stream 38V is recovered substantially free of $C_2$+ hydrocarbons Utilizing the dual demethanizer technique, a major amount of total demethanization heat exchange duty is provided by moderately low temperature refrigerant in unit 31 and overall energy requirements for refrigeration utilized in separating $C_2$+ hydrocarbons from methane and lighter components are decreased. The desired purity of ethene product is achieved by further fractionating the $C_2$+ liquid bottoms stream 30L from the first demethanizer zone in a de-ethanizer fractionation tower 40 to remove $C_3$ and heavier hydrocarbons in a $C_3$+ stream 40L and provide a second crude ethene stream 40V.

Pure ethene is recovered from a $C_2$ product splitter tower 50 via overhead 50V by co-fractionating the second crude ethene stream 40V and the first ethene-rich hydrocarbon crude product stream 34L to obtain a purified ethene product. The ethane bottoms stream 50L can be recycled to cracking unit 10 along with $C_2$+ stream 40L, with recovery of thermal values by indirect heat exchange with moderately chilled feedstock in exchangers 17, 18 and/or 20R.

Optionally methane-rich overhead 24V is sent to a hydrogen recovery unit, not shown, utilized as fuel gas, etc. As further described herein, all or a portion of this gaseous stream may be further chilled at ultra low temperature in rectification unit 38 along with other methane vapor to remove residual ethene. In this process modification, the serially connected rectification units include at least one intermediate rectification unit for partially condensing an intermediate liquid stream 24L from primary rectification overhead vapor 20V prior to the final serial rectification unit. Significant low temperature heat exchange duty may be saved by contacting at least a portion of said first demethanizer overhead vapor stream 32 with said intermediate liquid stream 24L. This may be an indirect heat exchange unit 33H, as depicted in FIG. 1. It is also feasible to contact these streams directly in a countercurrent contact zone operatively connected between the primary and secondary demethanizer zones, with methane-depleted liquid from said countercurrent contact zone being directed to a lower portion of the secondary demethanizer zone and methane-enriched vapor from said countercurrent contact zone being directed to an upper portion of the secondary demethanizer zone.

It will be understood that various optional unit operation arrangements may be employed within the inventive concept. For instance, the primary chilling train 20, 24, etc., may be extended to four or more serially connected dephlegmator units with progressively colder condensation temperatures. By sequencing overhead vapor stream 24F as the final rectification step by passing this stream via input line 38F, a final serial dephlegmator-type rectification unit is operatively connected as the final demethanizer rectification unit to obtain a final ultra-low temperature liquid reflux stream for recycle to a top portion of the final demethanizer fractionator.

In some separation systems a front end de-ethanizer unit is employed in the pre-separation operation 15 to remove heavier components prior to entering the cryogenic chilling train. In such configuration, an optional liquid stream 22A from the primary chiller provides a liquid rich in ethane and ethene for recycle to the top of the front end de-ethanizer tower as reflux. This technique permits elimination of a downstream de-ethanizer, such as unit 40, so that primary demethanizer bottoms stream 30L can be sent to product splitter 50.

Another optional feature of the present process configuration is the acetylene hydrogenation unit 60, connected to received at least one ethene-rich stream containing unrecovered acetylene, which may be reacted catalytically with hydrogen prior to final ethene product fractionation.

Figure 2:
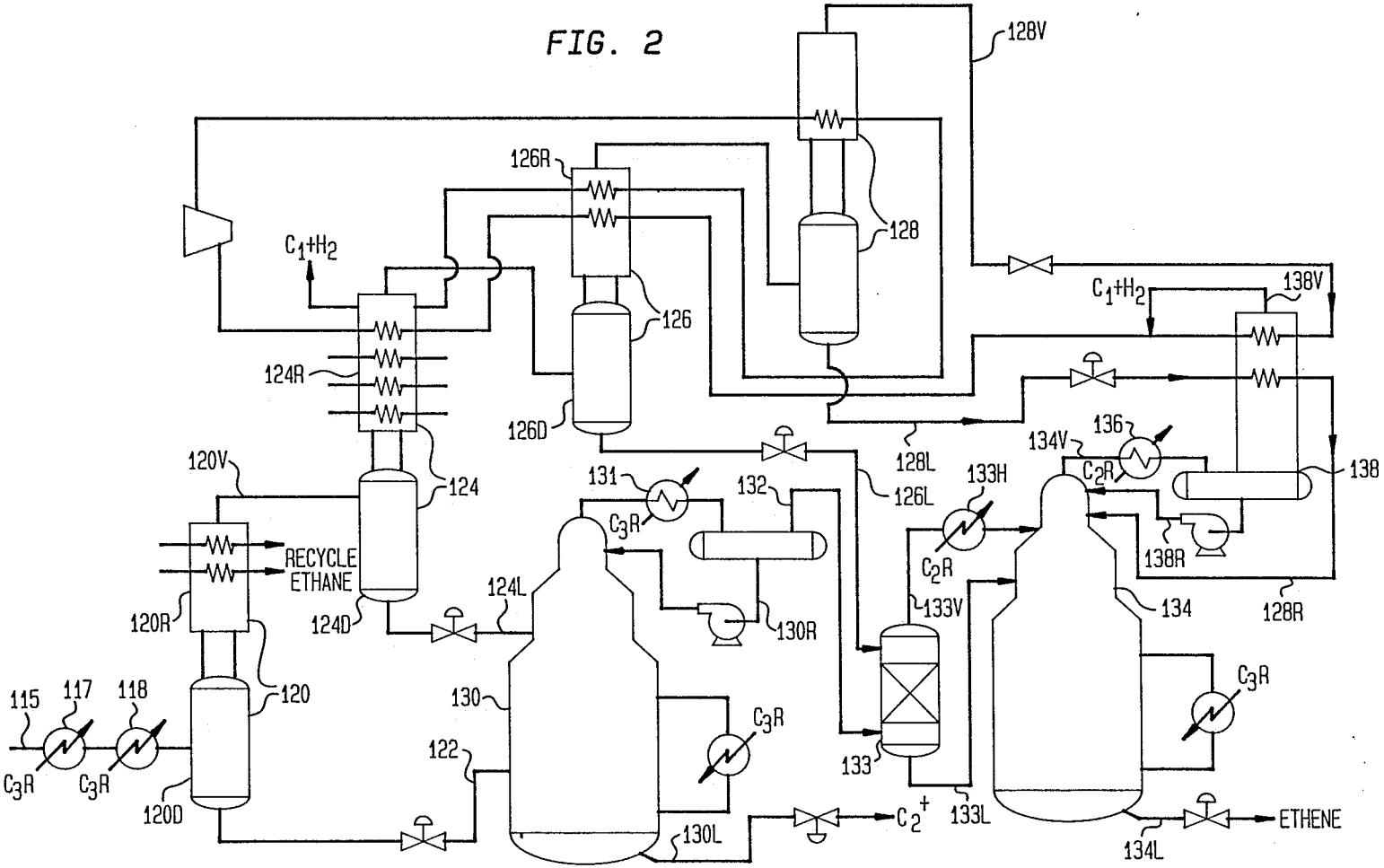

An improved chilling train using plural dephlegmators in sequential arrangement in combination with a multi-zone demethanizer fractionation system is shown in FIG. 2, wherein ordinal numbers correspond with their counterpart equipment in FIG. 1. In this embodiment several sources of low temperature refrigerants are employed. Since suitable refrigerant fluids are readily available in a typical refinery, the preferred moderately low temperature external refrigeration loop is a closed cycle propylene system ($C_3R$), which has a chilling temperature down to about 235° K. (−37F). It is economic to use $C_3R$ loop refrigerant due to the relative power requirements for compression, condensation and evaporation of this refrigerant and also in view of the materials of construction which can be employed in the equipment. Ordinary carbon steel can be used in constructing the primary demethanizer column and related reflux equipment, which is the larger unit operation in a dual demethanizer subsystem according to this invention. The $C_3R$ refrigerant is a convenient source of energy for reboiling bottoms in the primary and secondary demethanizer zones, with relatively colder propylene being recovered from the secondary reboiler unit. By contrast, the preferred ultra low temperature external refrigeration loop is a closed cycle ethylene system ($C_2R$), which has a chilling temperature down to about 172° K. (−150F), requiring a very low temperature condenser unit and expensive Cr-Ni steel alloys for safe construction materials at such ultra low temperature. By segregating the temperature and material requirements for ultra low temperature secondary demethanization, the more expensive unit operation is kept smaller in scale, thereby achieving significant economy in the overall cost of cryogenic separation. The initial stages of the dephlegmator chilling train can use conventional closed refrigerant systems, cold ethylene product, or cold ethane separated from the ethene product is advantageously passed in heat exchange with feedstock gas in the primary rectification unit to recover heat therefrom.

Referring to FIG. 2, dry compressed feedstock is passed at process pressure (3700 kPa) through a series of heat exchangers 117, 118 and introduced to the chilling train. The serially connected rectification units 120, 124, 126, 128, each have a respective lower drum portion 120D, 124D and upper rectifying heat exchange portion 120R, 124R, etc. The preferred chilling train includes at least two intermediate rectification units for partially condensing first and second progressively colder intermediate liquid streams respectively from primary rectification overhead vapor stream 120V prior to a final serial rectification unit 128. It is advantageous to fractionate the first intermediate liquid stream 124L in the primary demethanizer zone 130, and then fractionate a second intermediate liquid stream 126L in the secondary demethanizer zone 134. The sequence of dephlegmators and dual demethanizer relationship is analogous to FIG. 1, however, an intermediate liquid gas contact tower 133, such as a packed column, provides for heat exchange and mass transfer operations between intermediate liquid stream 126L and primary demethanizer overhead vapor 132 in countercurrent manner to provide a ethene-enriched liquid stream 133L passed to a middle stage of secondary demethanizer tower 134, where it is further depleted of methane. The methane-enriched vapor stream 133V is passed through ultra low temperature exchanger 133H for prechilling before being fractionated in the higher stages of tower 134. Optionally, the heat exchange function provided by unit 133 may be provided by indirectly exchanging the gas and liquid streams. The colder input to the secondary demethanizer reduces its condenser duty.

In addition to ultra low temperature condensation of vapor 134V in exchanger 136 to provide secondary demethanizer reflux stream 138R, a dephlegmator unit 138 condenses any residual ethene to provide a final demethanizer overhead 138V which is combined with methane and hydrogen from stream 128V and passed in heat exchange relationship with chilling train streams in the intermediate dephlegmators 126R, 124R. Ethene is recovered from the final chilling train condensate 128L by passing it an upper stage of secondary demethanizer 134 after passing it as a supplemental refrigerant in the rectifying portion of unit 138. A relatively pure $C_2$ liquid stream 134L is recovered from the fractionation system, typically consisting essentially of ethene and ethane in mole ratio of about 3:1 to 8:1, preferably at least 7 moles of ethene per mole of ethane. Due to its high ethene content, this stream can be purified more economically in a smaller $C_2$ product splitter column. Being essentially free of any propene or other higher boiling component, ethene-rich stream 134L can bypass the conventional de-ethanizer step and be sent directly to the final product fractionator tower. By maintaining two separate feedstreams to the ethene product tower, its size and utility requirements are reduced significantly as compared to conventional single feed fractionators. Such conventional product fractionators are typically the largest consumer of refrigeration energy in a modern olefins recovery plant.

Numerous modifications to the system may be made within the scope of the inventive concept. For instance, unitized construction can be employed to house the entire demethanizer function in a single multizone distillation tower. This technique is adaptable for retrofitting existing cyrogenic plants or new grass roots installations. Skid mounted units are desirable for some plant sites.

A material balance for the process of FIG. 2 is given in the following table. All units are based on steady state continuous stream conditions and the relative amounts of the components in each stream are based on 100 kilogram moles of ethene in the primary feedstock. The energy requirements of major unit operations are also given by providing stream enthalpy.

Material Balance

| Stream No. | 115 | 130 R | 122 | 120 V |
|---|---|---|---|---|
| Temp °C. | 16.1 | −34.4 | −18.3 | −34.4 |
| Pressure (kgf/cm$^2$) | 37.1 | 31.9 | 36.8 | 36.6 |
| Ethalpy (kCal, MM) | 3.1447 | 0.4455 | 0.2721 | 2.1873 |
| Vapor mol. fract. | 1.0 | 0 | 0 | 1.0 |
| Flowrates (kG-mol) | | | | |
| Total | 299.15 | 9.16 | 65.69 | 233.45 |
| Hydrogen ($H_2$) | 79.02 | .23 | .67 | 78.34 |
| Methane ($CH_4$) | 62.85 | 1.48 | 4.64 | 58.20 |
| Acetylene ($C_2H_2$) | 1.3 | .69 | .48 | .81 |
| Ethylene ($C_2H_4$) | 100.0 | 5.94 | 27.36 | 72.63 |
| Ethane ($C_2H_6$) | 32.4 | 1.64 | 12.63 | 19.79 |
| Propyne ($C_3H_4$) | .45 | 0 | .43 | .22 |
| Propylene ($C_3H_6$) | 12.8 | .58 | 10.53 | 2.30 |
| Propane ($C_3H_8$) | 5.8 | 0 | 5.02 | .77 |
| 1,3-Butadiene ($C_4H_6$) | 2.0 | 0 | 1.98 | .16 |
| 1-Butene ($C_4H_8$) | .66 | 0 | .65 | .58 |
| 1-Butane ($C_4H_{10}$) | .11 | 0 | .11 | .12 |
| 1-Pentene ($C_5H_{10}$) | .58 | 0 | .58 | 0 |
| Benzene ($C_6H_6$) | .52 | 0 | .51 | .12 |
| Toluene ($C_7H_8$) | .45 | 0 | .45 | 0 |
| 1-Hexene ($C_6H_{12}$) | .14 | 0 | .14 | 0 |
| $CO_2$ | .54 | 0 | 0 | .53 |
| Stream No. | 124 L | 126 L | 128 V | 128 R |
| Temp °C. | −39.7 | −77.6 | −126.1 | 99.4 |

-continued

| Material Balance | | | | |
|---|---|---|---|---|
| Pressure (kgf/cm$^2$) | 36.7 | 36.49 | 36.1 | 29.7 |
| Ethalpy (kCal, mm) | 0.3699 | 0.9027 | 0.9259 | 0.3529 |
| Vapor mol. fract. | 0 | 0 | 1.0 | 0 |
| Flowrates (kG mol) | | | | |
| Total | 86.35 | 24.14 | 115.24 | 7.72 |
| Hydrogen | 1.11 | .31 | 76.80 | .12 |
| Methane | 9.28 | 6.12 | 37.81 | 4.98 |
| Acetylene | .74 | .69 | 0 | .11 |
| Ethylene | 53.89 | 16.09 | .83 | 2.57 |
| Ethane | 18.20 | 1.54 | .11 | .48 |
| Propyne | .22 | 0 | 0 | 0 |
| Propylene | 2.29 | .11 | .11 | 0 |
| Propane | .77 | 0 | 0 | 0 |
| 1,3-Butadiene | .16 | 0 | 0 | 0 |
| 1-Butene | .46 | 0 | .11 | 0 |
| 1-Butane | .11 | 0 | 0 | 0 |
| 1-Pentene | 0 | 0 | 0 | 0 |
| Benzene | 0 | 0 | .11 | 0 |
| Toluene | 0 | 0 | 0 | 0 |
| 1-Hexene | 0 | 0 | 0 | 0 |
| $CO_2$ | 0 | 0 | .53 | 0 |
| Stream No. | 132 | 133 L | 138 V | 133 V |
| Temp °C. | −34.4 | −36.2 | −99.6 | −47.4 |
| Pressure (kgf/cm$^2$) | 31.9 | 31.8 | 31.1 | 31.8 |
| Ethalpy (kCal, mm) | 0.3132 | 0.1482 | 0.2253 | 0.2549 |
| Vapor mol. fract. | 1.0 | 0 | 1.0 | 1.0 |
| Flowrates (kG mol) | | | | |
| Total | 33.66 | 30.1 | 27.16 | 27.69 |
| Hydrogen | 1.79 | .79 | 2.22 | 2.02 |
| Methane | 13.85 | 5.05 | 24.92 | 14.92 |
| Acetylene | .13 | .17 | 0 | .30 |
| Ethylene | 15.05 | 21.05 | .18 | 10.08 |
| Ethane | 2.83 | 3.75 | 0 | .62 |
| Propyne | 0 | 0 | 0 | 0 |
| Propylene | .35 | .47 | 0 | 0 |
| Propane | 0 | 0 | 0 | 0 |
| 1,3-Butadiene | 0 | 0 | 0 | 0 |
| 1-Butene | 0 | 0 | 0 | 0 |
| 1-Butane | 0 | 0 | 0 | 0 |
| 1-Pentene | 0 | 0 | 0 | 0 |
| Benzene | 0 | 0 | 0 | 0 |
| Toluene | 0 | 0 | 0 | 0 |
| 1-Hexene | 0 | 0 | 0 | 0 |
| $CO_2$ | 0 | 0 | 0 | 0 |
| Stream No. | 134 L | 134 V | 138 R | 130 L |
| Temp °C. | −9.9 | −95.3 | −97.8 | 6.4 |
| Pressure (kgf/cm$^2$) | 31.6 | 31.1 | 31.1 | 32.5 |
| Ethalpy (kCal, mm) | 0.2169 | 0.5295 | 0.2148 | .6486 |
| Vapor mol. fract. | 0 | 1.0 | 0 | 0 |
| Flowrates (kG mol) | | | | |
| Total | 38.36 | 63.49 | 36.3 | 118.38 |
| Hydrogen | 0 | 2.40 | .18 | 0 |
| Methane | .37 | 60.38 | 35.46 | .69 |
| Acetylene | .20 | 0 | 0 | 1.10 |
| Ethylene | 33.69 | .70 | .68 | 66.20 |
| Ethane | 4.42 | .47 | .47 | 28.00 |
| Propyne | 0 | 0 | 0 | .45 |
| Propylene | .47 | 0 | 0 | 12.83 |
| Propane | 0 | 0 | 0 | 5.80 |
| 1,3-Butadiene | 0 | 0 | 0 | 2.00 |
| 1-Butene | 0 | 0 | 0 | .65 |
| 1-Butane | 0 | 0 | 0 | .11 |
| 1-Pentene | 0 | 0 | 0 | .58 |
| Benzene | 0 | 0 | 0 | .52 |
| Toluene | 0 | 0 | 0 | .45 |
| 1-Hexene | 0 | 0 | 0 | .14 |
| $CO_2$ | 0 | 0 | 0 | 0 |

It will be appreciated by one skilled in cryogenic engineering that the arrangement of unit operations allows reduction of reflux cooling requirements in the secondary demethanizer zone as compared to prior art single reflux demethanizer configurations. Use of ultra low temperature $C_2R$ refrigerant is minimized, or in some feedstock cases eliminated entirely at its lowest 172° K. temperature level.

While the invention has been described by specific examples, there is no intent to limit the inventive concept except as set forth in the following claims.

We claim:

1. A cryogenic separation method for recovering $C_1$+ hydrocarbons from cracked hydrocarbon feed gas comprising methane, ethene and ethane, wherein cold pressurized gaseous streams are separated in a plurality of dephlegmator units, each of said dephlegmator units being operatively connected to accumulate condensed liquid in a lower dephlegmator drum vessel by gravity flow from an upper dephlegmator heat exchanger comprising a plurality of vertically disposed indirect heat exchange passages through which gas from the lower drum vessel passes in an upward direction for cooling with refrigerant fluid by indirect heat exchange within said heat exchange passages, whereby gas flowing upwardly is partially condensed on vertical surfaces of said passages to form a reflux liquid in direct contact with the upward flowing gas stream to provide a condensed stream of cooler liquid flowing downwardly and thereby enriching condensed dephlegmator liquid gradually with $C_2$+ hydrocarbon components; comprising the steps of:

introducing dry feed gas into a primary dephlegmation zone having a plurality of serially connected, sequentially colder dephlegmator units for separation of feed gas into a primary methane-rich gas stream recovered at low temperature and at least one primary liquid condensate stream rich in $C_2$+ hydrocarbon components and containing a minor amount of methane;

passing at least one primary liquid condensate stream from the primary dephlegmation zone to serially connected demethanizer fractionators, wherein a moderately low cryogenic temperature is employed in a first demethanizer fractionator unit to recover substantially all of the methane from the primary liquid condensate stream in a first demethanizer overhead vapor stream and to recover a first $C_2$+ liquid demethanizer bottoms stream substantially free of methane, wherein said demethanizer overhead vapor stream is cooled with moderately low temperature coolant to provide liquid reflux for recycled to a top portion of the first demethanizer fractionator;

further separating at least a portion of the first demethanizer overhead vapor stream in an ultra-low temperature final demethanizer fractionator unit to recover a liquid ethene-rich predominantly $C_2$ hydrocarbon crude product stream and a final demethanizer ultra-low temperature overhead vapor stream substantially free of $C_2$+ hydrocarbons, wherein a major amount of total demethanization heat exchange duty is provided by moderately low temperature refrigerant and overall energy requirements for refrigeration utilized in separating $C_2$+ hydrocarbons from methane and lighter components are decreased; and fractionating said second crude ethene stream and said first ethene-rich $C_2$ hydrocarbon crude product stream to obtain a pure ethene product.

2. The process of claim 1 including the further step of fractionating the C2+ liquid bottoms stream from the first demethanizer fractionator to remove ethane and heavier hydrocarbons therefrom and provide a second crude ethene stream.

3. The process of claim 1 wherein liquid condensate is recovered from at least three serially connected dephlegmation zones, including the steps of contacting at least a portion of said first demethanizer overhead vapor stream in heat exchange relationship with an intermediate liquid stream from an intermediate dephlegmator zone, thereby reducing ultra low temperature cooling requirements for the second reflux condenser means.

4. The process of claim 3 wherein a countercurrent direct stream contact unit is operatively connected between the primary and secondary demethanizer zones, with liquid from said countercurrent contact zone being directed to a lower stage of the secondary demethanizer zone and vapor from said countercurrent contact zone being directed to a higher stage of the secondary demethanizer zone.

5. An improved cryogenic technique for separating and recovering $C_2+$ hydrocarbons from a feed gas containing hydrogen, methane, ethene and ethane, comprising the steps of:

separating cold pressurized gaseous feed gas in a series of at least three dephlegmator rectification units wherein liquid condensate is recovered from at least three serially connected dephlegmation zones, each of said dephlegmator units being operatively connected to accumulate condensed $C_2+$-rich liquid in a lower dephlegmator drum vessel by gravity flow from an upper dephlegmator heat exchanger comprising a plurality of vertically disposed indirect heat exchange passages through which gas from the lower drum vessel passes in an upward direction for cooling by indirect heat exchange within said heat exchange passages, whereby gas flowing upwardly is partially condensed on vertical surfaces of said passages to form a reflux liquid in direct contact with the upward flowing gas stream to provide a condensed stream of cooler liquid flowing downwardly and thereby enriching condensed dephlegmator liquid gradually with $C_2+$ hydrocarbon components;

introducing dry feed gas into a primary dephlegmation zone in said series of dephlegmation units for separation of feed gas into a primary methane-rich gas stream recovered and at least one primary liquid condensate stream rich in $C_2$ hydrocarbon components and containing a minor amount of methane;

passing at least one primary liquid condensate stream from the dephlegmation units to serially connected demethanizer fractionators, wherein a moderately low cryogenic temperature is employed in a first demethanizer fractionator unit to recover a substantially all of the methane from the primary liquid condensate stream in a first demethanizer overhead vapor stream and to recover a first $C_2+$ liquid demethanizer bottoms stream substantially free of methane;

further separating at least a portion of the first demethanizer overhead vapor stream in an ultra-low temperature final demethanizer fractionator unit to recover ethene-rich $C_2$ hydrocarbon liquid product and a final demethanizer ultra-low temperature overhead vapor stream;

contacting at least a portion of said first demethanizer overhead vapor stream in direct heat exchange relationship with an intermediate liquid stream from an intermediate dephlegmation zone in a countercurrent contact unit operatively connected between primary and secondary demethanizer fractionator zones, with liquid from said countercurrent contact zone being directed to a lower stage of the secondary demethanizer fractionator zone and vapor from said countercurrent contact zone being directed to a higher stage of the secondary demethanizer fractionator zone; and passing the final demethanizer overhead vapor stream to a final dephlegmator unit to obtain a final liquid reflux stream for recycle to a top portion of the final demethanizer fractionator and a methane-rich final dephlegmator overhead vapor stream substantially free of $C_2+$ hydrocarbons, whereby energy requirements for refrigeration utilized in separating the $C_2+$ hydrocarbons from methane and lighter components are low.

6. In a cryogenic separation method for recovering purified ethene from hydrocarbon feedstock gas consisting mainly of methane, ethene and ethane, wherein cold pressurized gaseous streams are separated in a plurality of sequentially arranged rectification units, each of said rectification units being operatively connected to accumulate condensed liquid in a lower liquid accumulator portion by gravity flow from an upper vertical rectifier portion through which gas from the lower accumulator portion passes in an upward direction for direct gas-liquid contact exchange within said reactifier portion, whereby methane-rich gas flowing upwardly is partially condensed in said rectifier portion with cold refluxed liquid in direct contact with the upward flowing gas stream to provide a condensed stream of cold liquid flowing downwardly and thereby enriching condensed liquid gradually with ethene and ethane components; the improvement comprising:

introducing dry feed gas into a primary rectification zone having a plurality of serially connected, sequentially colder rectification units for separation of feed gas into a primary methane-rich gas stream recovered at low temperature and at least one primary liquid condensate stream rich in $C_2$ hydrocarbon components and containing a minor amount of methane;

passing at least one primary liquid condensate stream from the primary rectification zone to a fractionation system having serially connected demethanizer zones, wherein a moderately low cryogenic temperature is employed in a first demethanizer fractionation zone to recover a major amount of methane from the primary liquid condensate stream in a first demethanizer overhead vapor stream and to recover a first liquid demethanized bottoms stream rich in ethane and ethene and substantially free of methane, wherein said demethanizer overhead vapor stream is cooled with moderately low temperature coolant to provide liquid reflux for recycle to a top portion of the first demethanizer zone;

further separating at least a portion of the first demethanizer overhead vapor stream in an ultra-low temperature final demethanizer zone to recover a first liquid ethene-rich $C_2$ hydrocarbon crude product stream and a final demethanizer ultra-low temperature overhead vapor stream substantially free $C_2+$ hydrocarbons, wherein a major amount of total demethanization heat exchange duty is provided by moderately low temperature coolant and overall energy requirements for refrigeration utilized in separating $C_2$+ hydrocarbons from methane and lighter components are decreased;

further fractionating the $C_2$+ liquid bottoms stream from the first demethanizer zone to remove ethane and heavier hydrocarbons therefrom and provide a second crude ethene stream; and fractionating said second crude ethene stream and said first ethene-rich hydrocarbon crude product stream to obtain a purified ethene product.

7. The process of claim 6 wherein said serially connected rectification units include at least one intermediate rectification unit for partially condensing an intermediate liquid stream from primary rectification overhead vapor prior to final serial rectification unit; and contacting at least a portion of said first demethanizer overhead vapor stream with said intermediate liquid stream directly in a countercurrent contact zone operatively connected between the primary and secondary demethanizer zones, with methane-depleted liquid from said countercurrent contact zone being directed to a lower portion of the secondary demethanizer zone and methane-enriched vapor from said countercurrent contact zone being directed to an upper portion of the secondary demethanizer zone.

8. The process of claim 6 including the step of passing the final demethanizer overhead vapor stream to a final rectification unit to obtain a final ultra-low temperature liquid reflux stream for recycle to a top portion of the final demethanizer fractionator and a methane-rich final rectification overhead vapor stream.

9. The process of claim 8 wherein a final serial dephlegmator-type rectification unit is operatively connected as the final demethanizer rectification unit to obtain a final ultra-low temperature liquid reflux stream substantially free of ethane for recycle to a top portion of the final demethanizer fractionator.

10. The process of claim 6 wherein said serially connected rectification units include two intermediate rectification units for partially condensing first and second progressively colder intermediate liquid streams respectively from primary rectification overhead vapor prior to a final serial rectification unit;

fractionating the first intermediate liquid stream in the primary demethanizer zone; and fractionating the second intermediate liquid stream in the secondary demethanizer zone.

11. The process of claim 10 including the step of contacting at least a portion of said first demethanizer overhead vapor stream with said second intermediate liquid stream substantially free of ethane in a countercurrent contact zone operatively connected between the primary and secondary demethanizer zones, with ethene-rich liquid from said countercurrent contact zone being directed to a lower portion of the secondary demethanizer zone and methane-enriched vapor from said countercurrent contact zone being directed to an upper portion of the secondary demethanizer zone.

12. The process of claim 6 wherein said moderately low temperature coolant is maintained at a temperature of about 235° K. to 290° K. and the ultra low temperature coolant is maintained below 235° K.

13. The process of claim 6 wherein pressurized moderately low temperature refrigerant is condensed in a refrigerant cycle in heat exchange relationship with a primary demethanizer reboiler unit to heat liquid methanized bottoms therein.

14. The process of claim 6 wherein said feedstock gas comprises cracking gas containing about 10 to 50 mole percent ethene, 5 to 20% ethane, 10 to 40% methane, 10 to 40% hydrogen, and up to 10% $C_3$ hydrocarbons.

15. The process of claim 6 wherein a major amount of ethane present in the feedstock gas is recovered in the first liquid demethanized bottoms stream; wherein said ethene-rich hydrocarbon crude product stream from the secondary demethanizer zone contains at least 7 moles of ethene per mole of ethane; and wherein at least 25% of feedstock ethene is passed to the ultra-low temperature final demethanizer zone along with less than 5 mole % $C_3$ components.

16. The process of claim 6 wherein said second crude ethene stream has substantially greater ethane content than said ethene-rich hydrocarbon crude product stream, and wherein said ethene-rich crude product stream is introduced separately to a final ethene product fractionation tower at a higher fractionation stage than said second crude ethene stream, thereby conserving refrigeration energy in said final ethene product fractionation tower.

17. The process of claim 6 including a closed loop moderately low temperature source of primary refrigerant consisting essentially of propylene and a separate closed loop ultra low temperature refrigerant source of secondary refrigerant consisting essentially of ethylene; and wherein overhead gas recovered from a final serial rectification unit contains a major portion of feedstock methane content and substantially all hydrogen in the feedstock.

18. The process of claim 6 wherein at least one of said rectification units comprises a dephlegmator, a packed column or tray contact unit.

19. An improved cryogenic separation system for recovering a higher-boiling first gaseous component from a lower-boiling second gaseous component in a feedstock mixture thereof comprising:

a source of primary refrigerant, moderately low temperature refrigerant and ultra low temperature refrigerant;

sequential chilling train means including a primary dephlegmator unit operatively connected in serial flow relationship with intermediate and final dephlegmator units, wherein a cold pressurized gaseous stream is separated in the series of dephlegmator units, each of said dephlegmator units having means for accumulating condensed liquid rich in higher-boiling component in a lower dephlegmator drum from an upper dephlegmator heat exchanger wherein gas flowing upwardly is partially condensed to form a reflux liquid in direct contact with upward flowing gas to provide a condensed stream of cooler liquid flowing downwardly and thereby enriching condensed dephlegmator liquid gradually with higher-boiling component;

means for feeding dry pressurized feedstock to the primary dephlegmator unit for sequential chilling to separate the feedstock mixture into a primary gas stream rich in lower boiling component recovered at about primary refrigerant temperature temperature and a primary liquid condensate stream rich in higher boiling component and containing a minor amount of lower boiling component;

fluid handling means for passing the primary liquid condensate stream from the primary dephlegmator unit to a low temperature fractionation system for recovering condensed lower-boiling components from condensed liquid, said fractionation system having a first fractionation zone including first reflux condenser means operatively connected to the source of moderately low temperature refrigerant to recover a major amount of lower-boiling component from the primary liquid condensate stream in a first fractionator overhead vapor stream and to recover a first liquid fractionator bottoms stream substantially free of lower-boiling component;

said fractionation system having a second fractionation zone including second reflux condenser means operatively connected to the source of ultra low temperature refrigerant to recover a liquid product stream consisting essentially of higher boiling component and a second fractionator ultra-low temperature overhead vapor stream; and means for passing an intermediate liquid stream condensed from at least one intermediate dephlengmator unit to to a middle stage of the second fractionation zone.

20. The system of claim 19 including means for contacting at least a portion of said first fractionator overhead vapor stream in heat exchange relationship with said intermediate liquid stream, thereby reducing ultra low temperature refrigeration requirements for the second reflux condenser means.

21. The system of claim 20 including a countercurrent direct stream contact unit operatively connected between the primary and secondary fractionator zones, with liquid from said countercurrent contact zone being directed to a lower stage of the secondary fractionator zone and vapor from said countercurrent contact zone being directed to a higher stage of the secondary fractionator zone.

22. The system of claim 19 including a closed loop moderately low temperature source of primary refrigerant consisting essentially of propylene and a separate closed loop ultra low temperature refrigerant source of secondary refrigerant consisting essentially of ethylene.

23. The system of claim 19 including a final dephlegmator unit connected to receive the second fractionator overhead vapor stream, including ultra low temperature refrigerant heat exchange means for obtaining a final liquid reflux stream for recycle to an upper stage of the second fractionation zone and a final dephlegmator overhead vapor stream substantially free of higher-boiling components.

* * * * *